US010413766B2

(12) United States Patent
Mete

(10) Patent No.: US 10,413,766 B2
(45) Date of Patent: Sep. 17, 2019

(54) TOOL AND METHOD FOR DRAINING A FIRE SPRINKLER SYSTEM AND A FIRE SPRINKLER

(71) Applicant: Shae Mete, Strathmore (AU)

(72) Inventor: Shae Mete, Strathmore (AU)

( * ) Notice: Subject to any disclaimer, the term of this patent is extended or adjusted under 35 U.S.C. 154(b) by 0 days.

(21) Appl. No.: 14/901,303

(22) PCT Filed: Jul. 11, 2014

(86) PCT No.: PCT/AU2014/050119
§ 371 (c)(1),
(2) Date: Dec. 28, 2015

(87) PCT Pub. No.: WO2015/003226
PCT Pub. Date: Jan. 15, 2015

(65) Prior Publication Data

US 2016/0151654 A1 Jun. 2, 2016

(30) Foreign Application Priority Data

Jul. 12, 2013 (AU) ..... 2013902575

(51) Int. Cl.

| | |
|---|---|
| ***A62C 37/00*** | (2006.01) |
| ***A62C 37/50*** | (2006.01) |
| ***A62C 35/64*** | (2006.01) |
| ***A62C 35/68*** | (2006.01) |
| ***A62C 35/60*** | (2006.01) |
| *A62C 37/12* | (2006.01) |
| *A62C 37/14* | (2006.01) |

(52) U.S. Cl.
CPC ..... *A62C 37/50* (2013.01); *A62C 35/60* (2013.01); *A62C 35/64* (2013.01); *A62C 35/68* (2013.01); *A62C 37/12* (2013.01); *A62C 37/14* (2013.01)

(58) Field of Classification Search
CPC ..... A62C 37/50; A62C 37/12; A62C 37/14; A62C 31/02; A62C 35/64; A62C 35/68; F16L 5/06; F16L 19/055; F16L 23/08; F16L 33/04; F16L 37/124; F16L 55/172
USPC ..... 169/37, 54, 60, 58, 57, 21, 5–8, 16–18, 169/90, 38, 39, 40, 41, 42
See application file for complete search history.

(56) References Cited

U.S. PATENT DOCUMENTS

| | | | |
|---|---|---|---|
| 1,582,758 | A | 4/1926 | Jones |
| 3,245,423 | A | 4/1966 | Hansen |
| 4,245,666 | A | 1/1981 | Norris |
| 4,883,102 | A | 11/1989 | Gabriclyan |
| 5,018,770 | A | 5/1991 | Beasley |

(Continued)

FOREIGN PATENT DOCUMENTS

WO WO 2012/015351 2/2012

OTHER PUBLICATIONS

International Search Report from PCT/AU2014/050119 dated Oct. 2, 2014.

(Continued)

*Primary Examiner* — Viet Le
(74) *Attorney, Agent, or Firm* — Adsero IP

(57) ABSTRACT

A tool for draining a fire sprinkler system through a fire sprinkler, comprising: a housing configured for cooperation with the sprinkler to collect fluid flowing from the sprinkler; an actuator to activate the sprinkler; and a conduit in fluid communication with the housing 5 and through which the fluid can be drained.

22 Claims, 7 Drawing Sheets

(56) References Cited

U.S. PATENT DOCUMENTS

| | | | | |
|---|---|---|---|---|
| 5,101,868 | A * | 4/1992 | Balch | B67D 1/16 137/312 |
| 5,117,876 | A | 6/1992 | Kuntz | |
| 5,540,250 | A * | 7/1996 | Mullins | F16L 55/1015 137/75 |
| 5,743,337 | A | 4/1998 | Macdonald | |
| 5,752,540 | A | 5/1998 | Hansel | |
| 6,009,954 | A * | 1/2000 | Phillips | A62C 35/023 169/16 |
| 6,845,784 | B2 | 1/2005 | Pascznk | |
| 7,055,614 | B1 | 6/2006 | Ide | |
| 2009/0020166 | A1* | 1/2009 | McHugh, IV | A62C 35/62 137/314 |
| 2012/0255629 | A1* | 10/2012 | Goss | A62C 35/68 137/377 |
| 2012/0298381 | A1* | 11/2012 | Taylor | A62C 35/64 169/13 |
| 2013/0126194 | A1* | 5/2013 | Kjellberg | A62C 31/07 169/46 |

OTHER PUBLICATIONS

European Search Report (extended) from EP App No. 14822081.7 dated Feb. 1, 2017.

* cited by examiner

TOOL AND METHOD FOR DRAINING A FIRE SPRINKLER SYSTEM AND A FIRE SPRINKLER

RELATED APPLICATIONS

This application is a 35 U.S.C. § 371 national phase application of PCT/AU2014/050119 (WO 2015/003226), filed on Jul. 11, 2014, entitled "Tool and Method for Draining a Fire Sprinkler System and a Fire Sprinkler", which application claims priority to Australian Application No. 2013902575, filed Jul. 12, 2013, which is incorporated herein by reference in its entirety.

FIELD OF THE INVENTION

The present invention relates to a tool and method for draining a fire sprinkler system, and a fire sprinkler for use with the tool and method.

BACKGROUND OF THE INVENTION

Fire sprinklers are designed to distribute an extinguishing fluid, such as water, throughout a building as widely as possible. As such, they are generally pressurised to high levels and activation can cause considerable damage to a building and it's contents. For example, activation of fire sprinklers in offices can damage computers and files and activation in retail stores can cause water damage to stock.

Fire sprinklers can also pose a safety threat to personnel involved with building testing and maintenance, regardless of whether their work is related to the sprinklers. For example, ladders or other equipment can conic into contact with sprinklers, potentially activating the sprinklers.

Eire sprinkler systems can include numerous sprinklers, which are generally installed roughly 4 meters apart. These sprinklers require maintenance and testing and can require activation to allow a system to be drained or to check operation. Also, it can be difficult to determine whether a sprinkler is pressurised and a fire sprinkler can be dangerous and difficult to switch off once activated.

Examples of the invention seek to provide a tool and method for draining a fire sprinkler system.

SUMMARY OF THE INVENTION

According to the present invention, there is provided a tool for draining a fire sprinkler system through a fire sprinkler, comprising: a housing configured for cooperation with the sprinkler to collect fluid flowing from the sprinkler; an actuator to activate the sprinkler; and a conduit in fluid communication with the housing and through which the fluid can be drained.

In one embodiment, the housing is configured for engagement with the sprinkler. In another embodiment, the housing is configured for engagement with an adaptor fixed to the sprinkler. In one form, the housing is formed of a metallic material. In another form, the housing is formed from plastic using an injection moulding process.

According to preferred embodiments, said actuator has a pin extending internally of the housing and which is movable to displace a temperature responsive element of the sprinkler to open a valve of the sprinkler and allow fluid to flow from the sprinkler. Preferably, the temperature responsive element is a bulb and the pin is configured to break the bulb. Preferably, the pin is operable externally of the housing.

In preferred embodiments, the tool further includes a lock which is operable to fix the housing relative to the sprinkler. The lock can include a sleeve which is movable relative to the housing to operate the lock. The sleeve can be coaxial with and extend at least partially around the housing.

The lock preferably includes at least one locking element which is configured for releasable engagement with the sprinkler or an adaptor fixed to the sprinkler. Preferably, the at least one locking element is radially movable. In one form, the at least one locking element is in the form or a resiliently flexible arm which is radially movable to facilitate engagement and disengagement of the tool from the sprinkler.

The or each locking element can have a spherical portion configured for receipt in a correspondingly shaped recess formed in the sprinkler or the adaptor. Preferably, the or each locking element is in the form of a ball disposed within a recess formed in the housing.

The tool cart comprise a ball valve to control flow of water through the conduit. The housing can have a seal extending between the sprinkler and the housing. The tool can further comprise a pressure transducer for determining the pressure of a chamber formed between the housing and the sprinkler. The tool can further comprise a pump to pressurise the chamber with air or water to determine whether the chamber is sealed. The tool can be configured for mounting to an end of a pole.

According to the present invention there is also provided a sprinkler configured for engagement with a tool of the above described type.

Preferably the sprinkler has a base, the base being correspondingly shaped with the housing of the tool. Preferably, the base is circular.

According to the present invention there is also provided a method of draining a fire sprinkler system through a fire sprinkler, including the steps of: fixing a tool relative to the sprinkler, the tool including a housing configured for cooperation with the sprinkler to collect fluid flowing from the sprinkler, an actuator for activating the sprinkler, and a conduit in fluid communication with the housing and through which the fluid can be discharged; operating the actuator to activate the sprinkler; and draining fluid from the sprinkler through the conduit.

The tool can be fixed to the sprinkler. The step of activating the sprinkler can include breaking a bulb of the sprinkler.

BRIEF DESCRIPTION OF THE DRAWINGS

Preferred embodiments of the invention will be further described, by way of non-limiting example only, with reference to the accompanying drawings in which.

DETAILED DESCRIPTION

Figure 1:
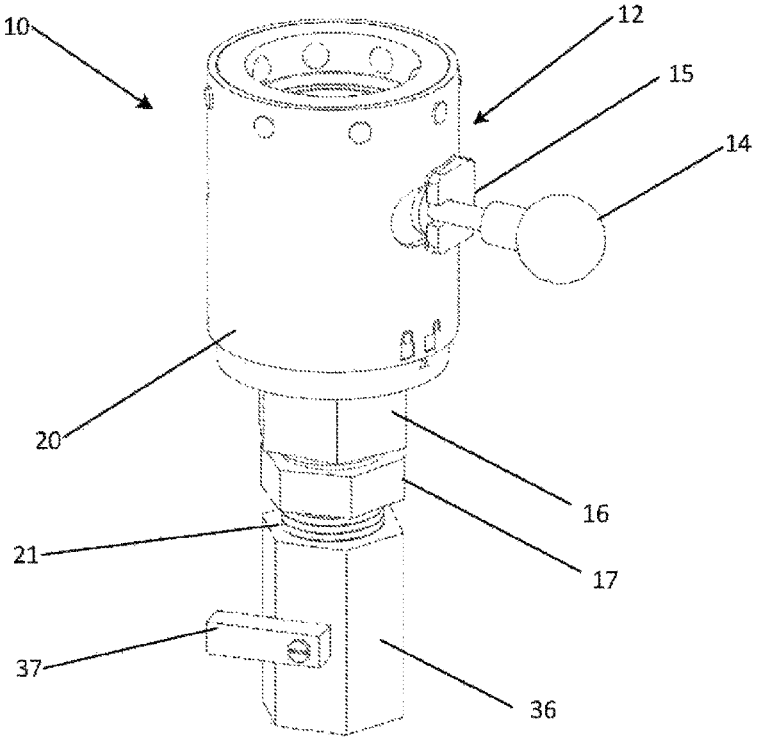
FIG. 1 is a perspective view of a drainage tool of one embodiment of the invention.

With reference to FIG. 1, there is shown a tool 10 according to a preferred embodiment of the invention. The tool 10 is configured for discharging or safely draining a fire sprinkler system through a fire sprinkler 26 (refer FIGS. 5 and 6) and includes a housing 12 configured for cooperation with the sprinkler 26 to collect fluid flowing from the sprinkler. In the illustrated tool 10, the housing 12 is adapted to be directly coupled to the sprinkler though it may also be indirectly coupled. The tool 10 also includes an actuator 14 to activate the sprinkler and a conduit 16 which is in fluid communication with the housing 12 and through which fluid from the sprinkler can be discharged.

Preferred embodiments of the tool 10 provide a device that allows for a fire sprinkler system to be safely drained through a fire sprinkler in a manner in which the extinguishing fluid is controlled, thereby preventing the fluid causing damage. If a drain is positioned close to the sprinkler to be activated, a hose (not shown) may be connected to the conduit 16 so that the fluid may be directed directly into the drain. If a drain is not positioned to close to the sprinkler, a large bin may be used to collect the fluid. If a bin is used, a hose may be fitted to the conduit 16 so as to extend from the tool 10 to the bin or the fluid may flow directly from the conduit 16. It will, be appreciated that the tool 10 allows for any sprinkler in a system comprising numerous sprinklers to be used for draining the system. The tool also allows the system to be drained at multiple locations to ensure that the system can be completely drained and that no water traps exist.

Figure 2:
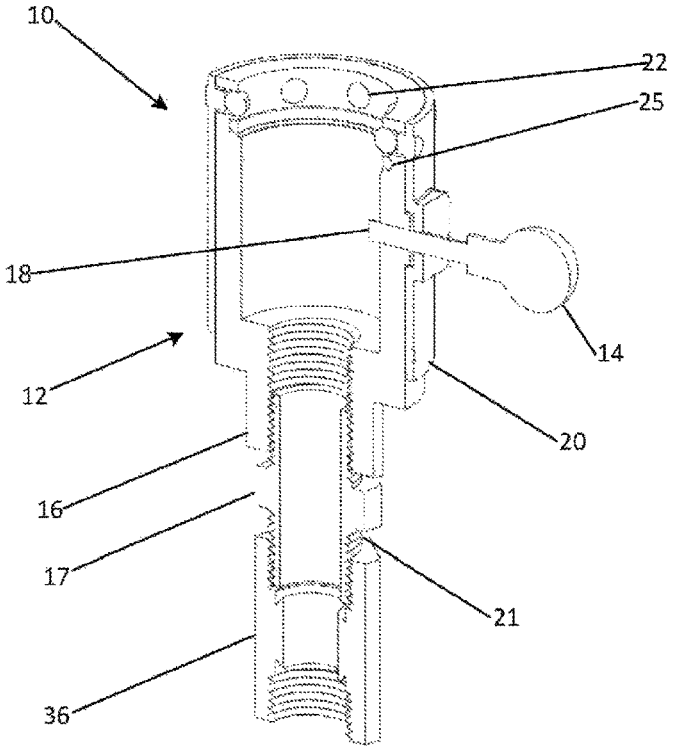
FIG. 2 is a perspective view of the tool, the tool being sectioned about a longitudinal axis.
Figure 12:
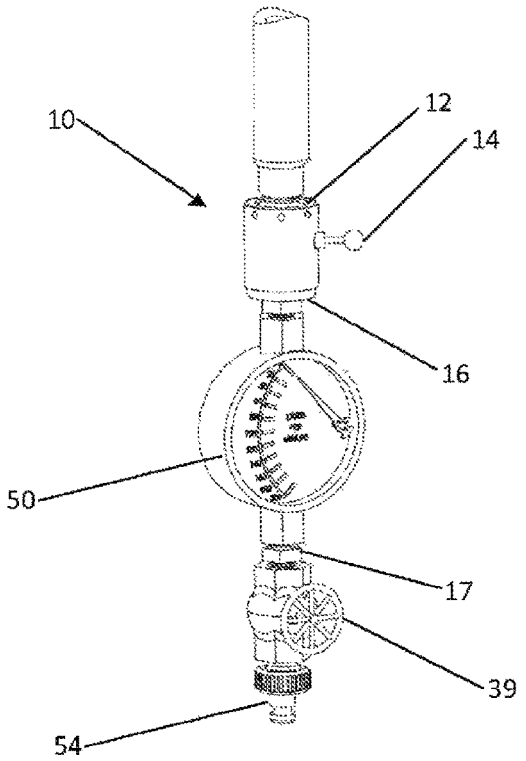
FIG. 12 is a perspective view of a drainage tool having a flow meter fitted thereto.
Figure 13:
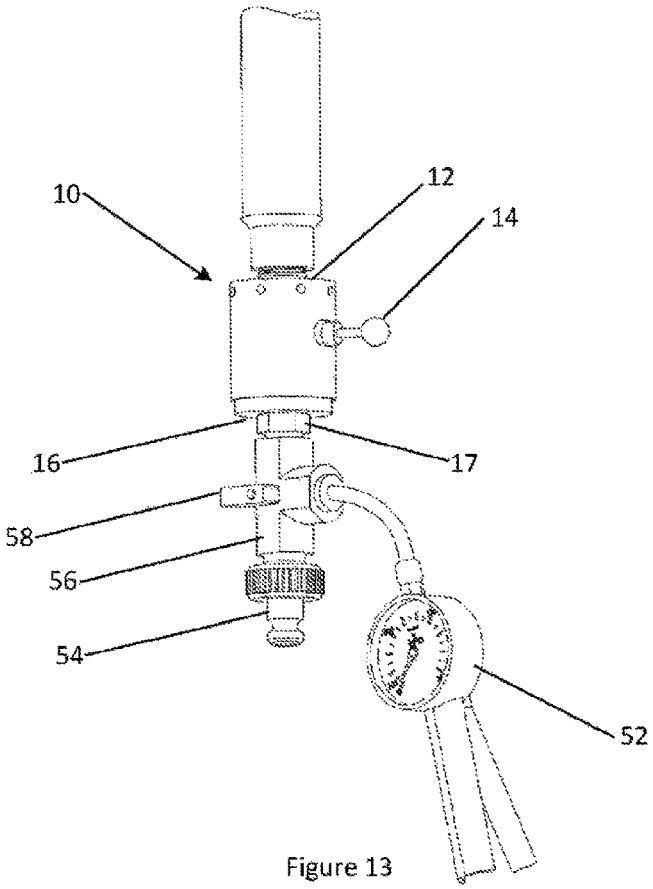
FIG. 13 is a perspective view of a drainage tool having a baud pump fitted thereto.

The conduit 16 is illustrated as having an internal, or female thread for receipt of a fitting, though it will be appreciated that it may also be provided with an external male thread. As illustrated in FIGS. 1 and 2, a fitting 17 may be provided to convert the female socket of the tool 10 to a male fitting 21 to which standard fittings having a female connection, such as flow meters or ball valves, can be fitted. The tool may be provided with other types of connections, such as a standard hose connection 54, as illustrated in FIGS. 12 and 13.

The illustrated housing 12 is configured for engagement with the sprinkler, though it will be appreciated that housing may also be configured for engagement with an adaptor fixed to the sprinkler. The adaptor may be fixed to a water pipe so that the sprinkler is received by the adaptor or the adaptor may simply be an intermediate part for connection with the sprinkler. The housing 12 may have a seal 25 extending between the sprinkler and the housing 12 or between the housing and an adaptor, if used.

The actuator 14 has a pin 18 which extends internally of the housing 12 and which is movable to displace a temperature responsive element of the sprinkler to open a valve 23 of the sprinkler 26 and allow fluid to flow from the sprinkler 26. In the embodiment illustrated in FIG. 6, the sprinkler 26 is of the type having a glass bulb 19 which, in normal operation, holds conical valve member 23 in a closed condition. When activated, the bulb 19 breaks, thereby allowing the valve member 23 to drop so that the valve is opened and fluid can flow from the sprinkler 26. The pin 18 of the illustrated actuator 14 is configured to engage and break a bulb 19 of the sprinkler to activate the sprinkler. The pin 18 is operable externally of the housing 12 so that a user may remotely break the bulb 19 once the tool 10 is secured relative to a sprinkler. In the illustrated embodiment, the pin 18 is slidable so as to be advanced towards the bulb 19, though it will be appreciated that other arrangements are also possible. For example, the pin may be threaded and retained in a threaded aperture so as to be advanced by rotation of the pin. Furthermore, the pin may be pivotable so as to selectively bring an end of the pin into engagement with the bulb 19. In such an embodiment the pin may be leveraged to increase a force of the pin on the bulb 19.

The actuator 14 may include, a safety lock to prevent activation of the sprinkler 26 until the tool is firmly coupled to the sprinkler 26. In the illustrated embodiment, the safety lock includes a raised section 15 which surrounds the pin 18 and prevents operation of the actuator 14 until a lock of the tool, which is described further below, has been operated. It will be appreciated that the illustrated safety lock is configured for use with the illustrated lock and that the safety lock may be otherwise configured.

Although tool 10 is described for use with a sprinkler 26 having a bulb 19, it will be appreciated that the tool 10 is also suitable for use with sprinklers having a fusible link. In this regard, the pin 14 is also operable to break the fusible link and open a valve of such a sprinkler.

As fire sprinklers are generally pressurised to a high level, the tool 10 is provided with a lock which is operable to fix the housing 12 relative to the sprinkler so that the tool 10 does not become dislodged on activation of the sprinkler when the extinguishing fluid flows from the sprinkler under high pressure.

In one form, the lock includes a sleeve 20 which is movable relative to the housing 12 to operate the lock. In the described embodiment, the sleeve 20 is coaxial with and extends around the housing 12, though it will be appreciated that the sleeve need not extend completely around the housing 12 and may be in the form of a cuff.

The lock includes at least one locking element which is configured for releasable engagement with the sprinkler or an adaptor fixed to the sprinkler. The or each locking element may be radially movable, so as to provide releasable engagement with the sprinkler or an adaptor fixed to the sprinkler.

The locking elements can be in the form of a plurality of balls 22 and the lock illustrated in FIG. 2 includes 8 halls disposed around the housing within a recess formed in the housing. Although 8 balls are provided to ensure a positive connection between the tool and the sprinkler, it will be appreciated that arrangements having less than 8 balls, such as 3 or 4 balls for example, or more than 8 balls such as 10 or 12 balls for example, may also provide adequate performance. In other embodiments, the locking element(s) may simply have spherical end portions configured for receipt in a correspondingly shaped recess formed in the sprinkler or an adaptor fitted to the sprinkler.

Figure 3:
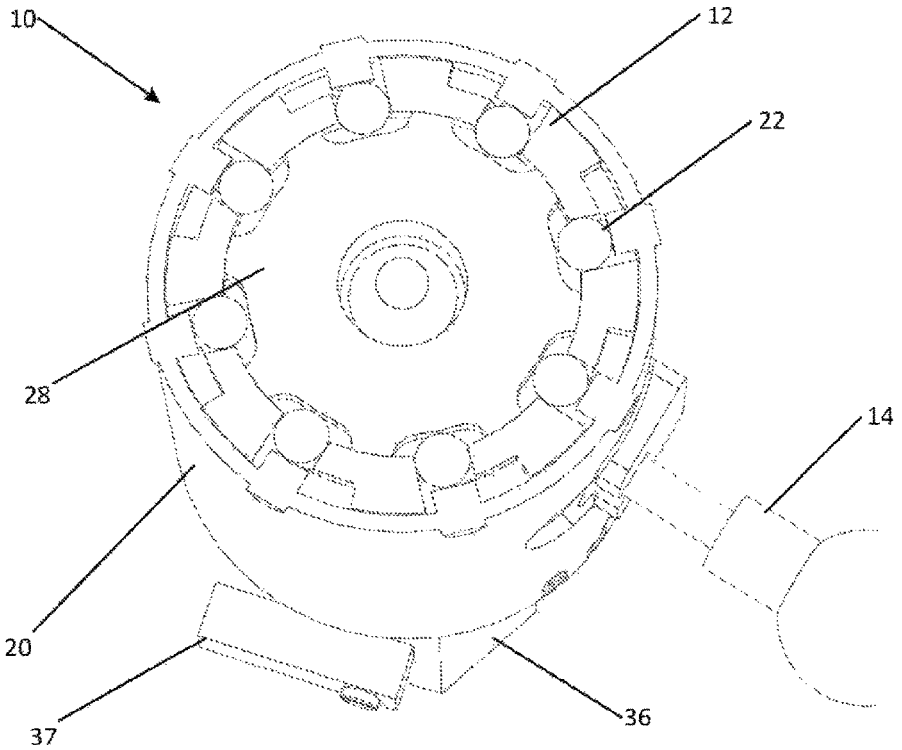
FIG. 3 is a perspective view of the tool, the tool being sectioned about a transverse axis.
Figure 4:
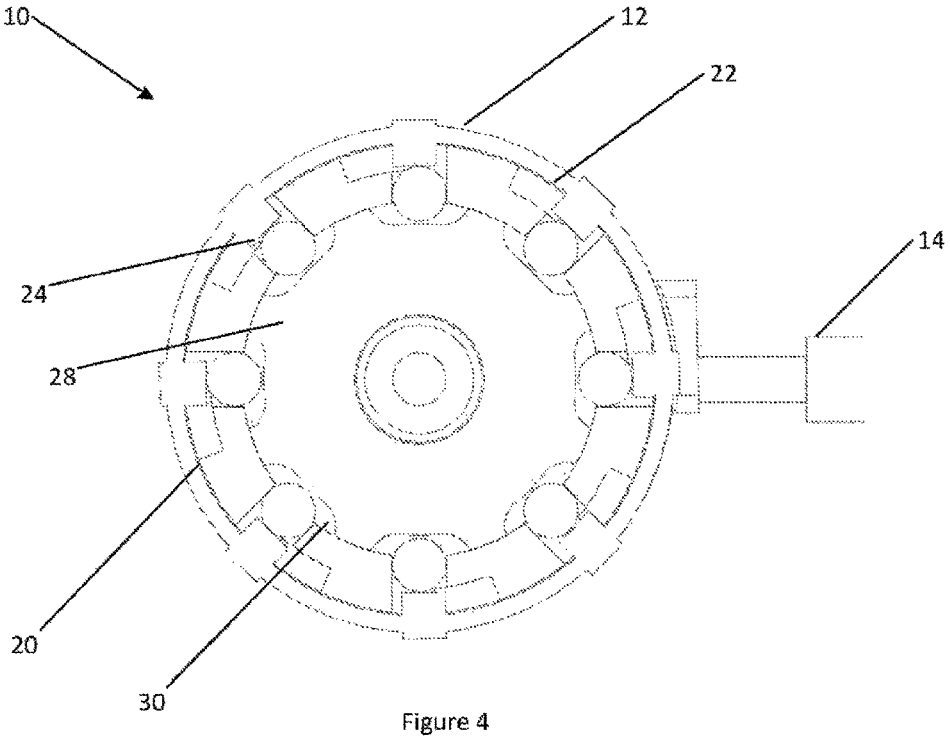
FIG. 4 is a plan view of the tool of FIG. 3.
Figure 5:
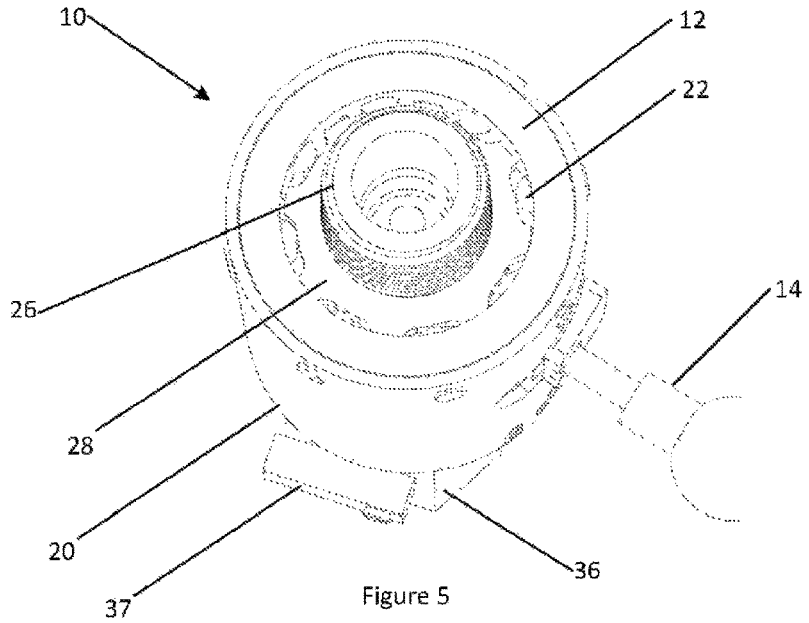
FIG. 5 is a perspective view of the tool fitted to a sprinkler.

FIGS. 3 and 4 further illustrate the balls 22 and their placement in the tool 10. The balls 22 are biased radially outwards and rotation of the sleeve 20 in a direction A causes extensions 24 to contact the balls and urge them inwards to a locking position. As can be seen in FIG. 5, the balls 22 are, once in a locking position, received in correspondingly shaped apertures formed in a sprinkler 26 so as to lock the tool 10 to the sprinkler 26.

Figure 6:
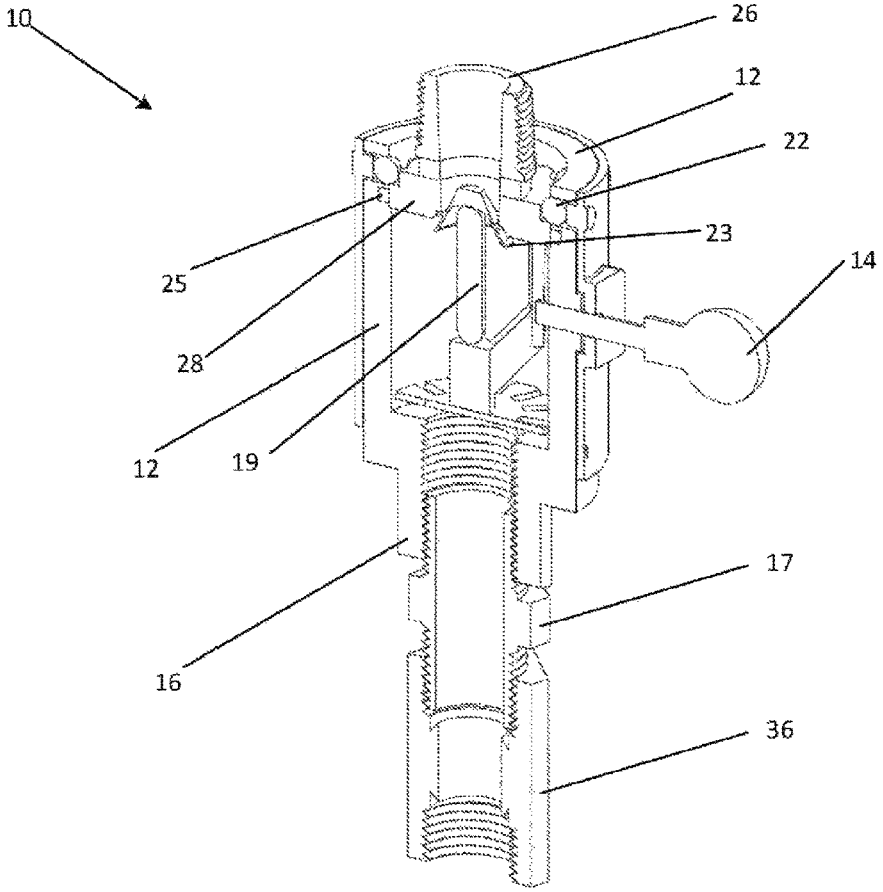
FIG. 6 is a perspective view of the tool fitted to a sprinkler, the tool and sprinkler being sectioned about a longitudinal axis.

The locking effect of the halls 22 can be further seen in FIG. 6. The sprinkler 26 has a generally circular base 28 with apertures 30 (refer FIG. 4) formed in it. In use the balls 22 are urged radially outward in a resting state so that the housing 12 may be received over the sprinkler 26. Once in position, the sleeve 20 is rotated so that the balls are moved radially inward into the apertures 30, thereby creating an interference between the balls 22 and the base 28. The lock may be provided with a visual indicator, such as that shown in FIG. 1, that allows a user to readily determine if the sleeve 20 has been sufficiently rotated so as to be in a position where a positive lock between the tool and the sprinkler is obtained.

Figure 7:
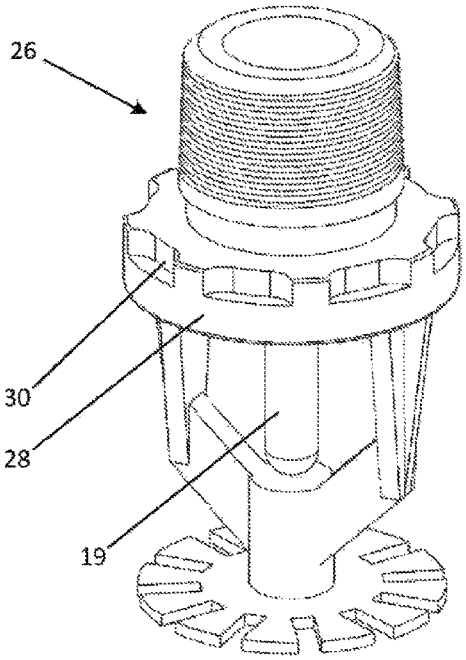
FIG. 7 is a perspective view of a fire sprinkler of one embodiment of the invention.
Figure 8:
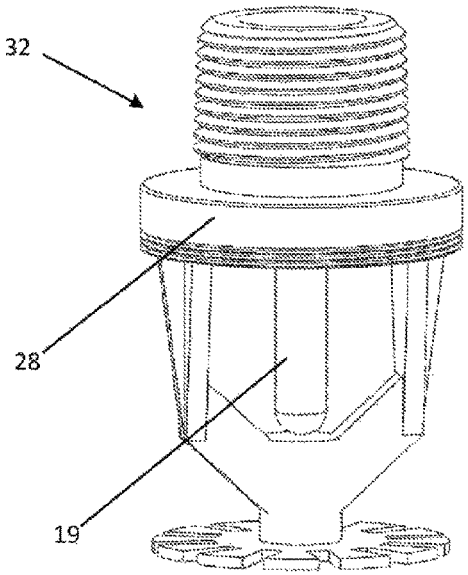
FIG. 8 is a perspective view of a fire sprinkler of another embodiment of the invention.
Figure 9:
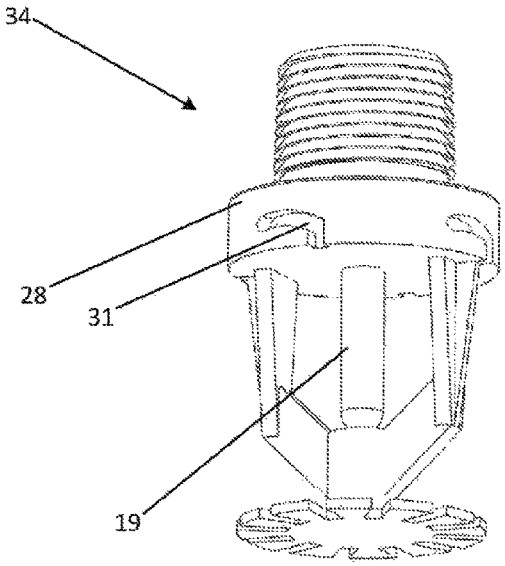
FIG. 9 is a perspective view of a fire sprinkler of another embodiment of the invention.

The lock described above is one possible configuration for use with a sprinkler 26 such as that illustrated in FIG. 7. With reference to FIGS. 8 and 9, differently configured sprinklers 32, 34 are provided for use with differently configured locks. In this regard, the lock may be in the form of a threaded member which can screw onto a thread formed in a circular base of the sprinkler 32 such as that shown in FIG. 8. Furthermore, the lock may include a series of inwardly extending pins configured to be received in correspondingly shaped slots 31 formed in a circular base of the sprinkler 34 to form a reverse bayonet type socket. In other embodiments, the housing 12 may be of a shape which is not circular and configured for use with sprinklers having a correspondingly shaped base which is also other than circular. In this regard, housing/base pairs may be oval shaped or triangular, for example and allow engagement of the tool 10 and sprinkler so that torque can be transmitted, thereby allowing the tool 10 to be used to install or remove the sprinkler. It will also be appreciated that other configurations of locks are also possible.

By configuring the tool 10 and sprinkler 26 so as to be correspondingly shaped, an anti tamper arrangement is provided so that only personnel having access to tool 10 can service or attempt to service a fire sprinkler, thereby potentially preventing an unskilled person from servicing the sprinkler.

The tool 10 may also include a valve, such as a ball valve 36 to control flow of water through the conduit 16. The ball valve may be operable via a lever 37 or a rotatable element 39 (refer FIG. 12). Advantageously, this allows the flow to be controlled as required so that the fluid can be conveniently discharged. Previously, once a fire sprinkler has been activated, the flow of water was very difficult, if not impossible, to stop.

It is often difficult or impractical to determine whether a fire sprinkler is pressurised, particularly at different locations in the system. The tool may further comprise a pressure transducer (not shown) for determining the pressure of a chamber formed between the housing 12 and the sprinkler 26. The pressure transducer can thus indicate whether the sprinkler system is pressurised. A tool having a pressure transducer may also be used for testing purposes to verify that the pressure of fluid at a sprinkler meets the pressure required or designed for. In use, a tool having a valve may be fitted to the sprinkler, the valve closed and the sprinkler activated so that the system pressure can be measured. Once the pressure has been measured the sprinkler can be drained for replacement. Similarly, the flow rate of fluid through the sprinkler can be measured if a flow meter, such as that indicated by reference numeral 50 in FIG. 12. The flow meter 50 is fitted to the conduit 16 so that the fluid flowing from the sprinkler 26 passes through the flow meter 50, thereby allowing measurement of the flow rate at the sprinkler 26. Measurement may be made at different sprinklers in the system to identify potential faults or verify performance. Previously, flow tests could only be performed at fixed locations, such as annubars installed at control valves. Use of the described tool and method allows flow rates to be measured anywhere in the sprinkler system, particularly at locations which are hydraulically disadvantaged and more importantly, through the orifice of the sprinkler to assess and confirm if the actual flow rate is sufficient and that the installed sprinkler is of the correct type.

As illustrated in FIG. 13, the tool 10 may also be provided with a pump 52 to pressurise the chamber formed between the housing 12 and the sprinkler 26 to determine whether the chamber is sealed. The pump 52 may operate with air or water and provides that a user can check that the tool 10 is positively and sealingly engaged with the sprinkler 26 before the sprinkler 26 is activated, thereby further reducing the chances of accidental spillage. The pump 52 is connected to the tool 10 via a housing 56 which forms a "T" piece connector. The housing 56 includes a valve, operable via lever 58, which is closed while the chamber is pressurised.

Given that fire sprinklers are generally fitted to a ceiling, the tool may be configured for mounting to an end of a pole so that personnel wanting to test or discharge a sprinkler are not required to climb a ladder to use the tool.

As illustrated in FIGS. 7 to 9, preferred embodiments of the sprinklers 26, 32, 34 have a circular base which is configured for engagement by a seal 25 (refer FIG. 2) provided in the housing of the tool so as to provide, a surface against which a seal can be formed to prevent leakage of the extinguishing fluid. In embodiments in which the base or the sprinkler is not circular, a differently configured seal will be required.

Figure 10:
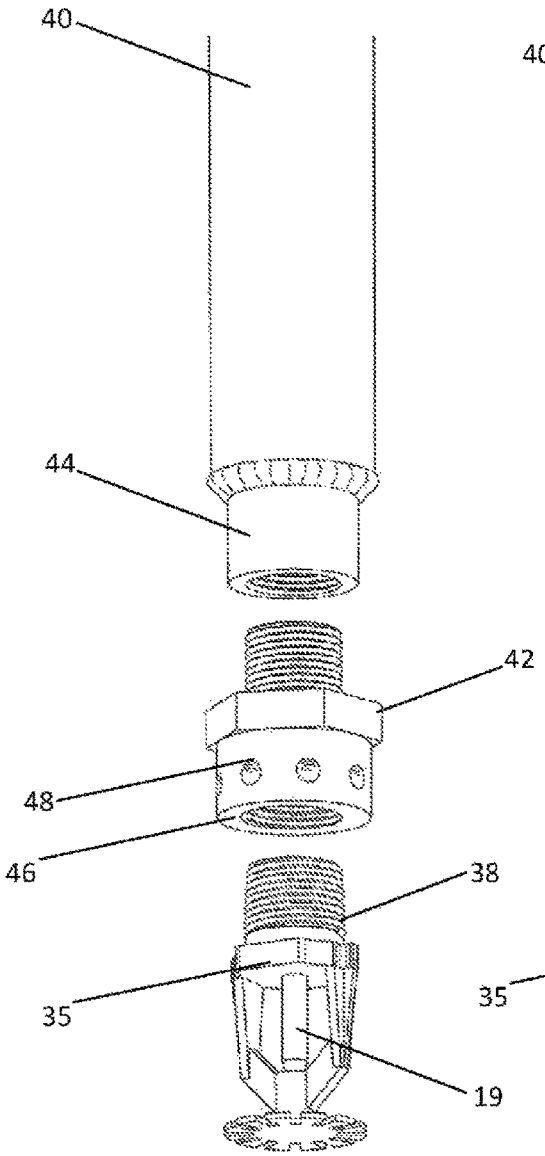
FIG. 10 is a perspective view of a fire sprinkler of one embodiment of the invention fitted to a water pipe.
Figure 11:
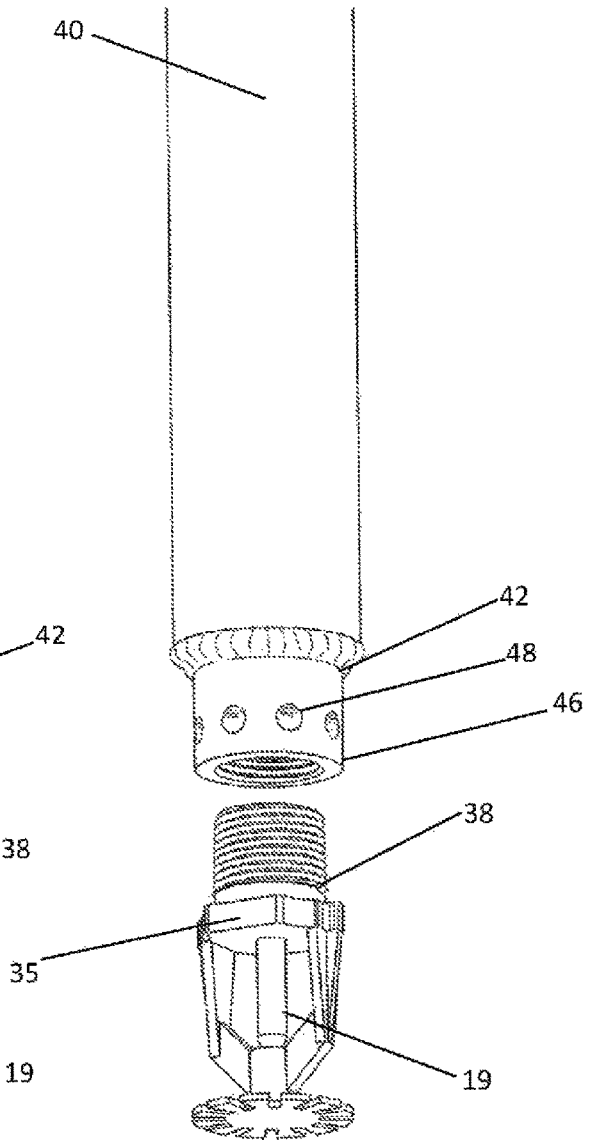
FIG. 11 is a perspective view of a fire sprinkler of another embodiment of the invention fitted to a water pipe.

FIGS. 10 and 11 illustrate a sprinkler 38 of the type commonly used with a fire sprinkler system. The sprinkler 38 is fitted to a pipe 40 which forms part of the fire sprinkler system. The illustrated conventional sprinkler 38 is of the type manufactured by Tyco, though it will be appreciated that other types of conventional sprinklers may also be used. A base of the sprinkler 38 has flat sides 35 to allow a wrench to engage the sprinkler during installation or removal. To allow a tool 10 to be fitted to the conventional sprinkler 38, an intermediate adaptor 42 may be provided. The adaptor 42 may be welded directly to the pipe 40, as in FIG. 11, or may be received in a further fitting 44 which is welded to the pipe, as illustrated in FIG. 10. The adaptor 42 provides a cylindrical portion 46 against which a seal can be formed. The adaptor also provides a plurality of apertures 48 for receipt of locking balls, such as those previously described. It will be appreciated that adaptor 42 may be otherwise configured to accommodate for different locks. In this regard, the adaptor 42 may be configured in a manner similar to sprinklers 32 and 34 illustrated in FIGS. 8 and 9.

In one form the described tool is constructed having a housing formed of steel or other metals, such as aluminium for example, though it will be appreciated that other materials such as plastics may be also used. Tool 110, as illustrated in FIG. 14, is constructed of plastic and tool 210, as illustrated in FIGS. 15 and 16, is of a hybrid construction with a plastic housing 210 and a steel sleeve 220.

Figure 14:
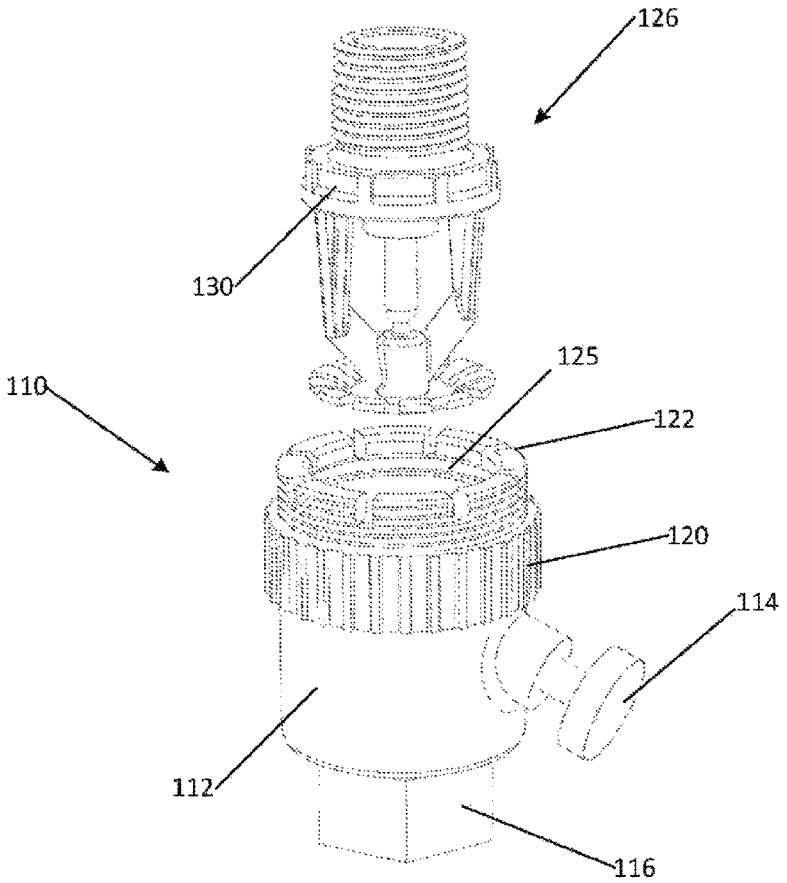
FIG. 14 is a perspective view of a drainage tool of another embodiment of the invention.
Figure 15:
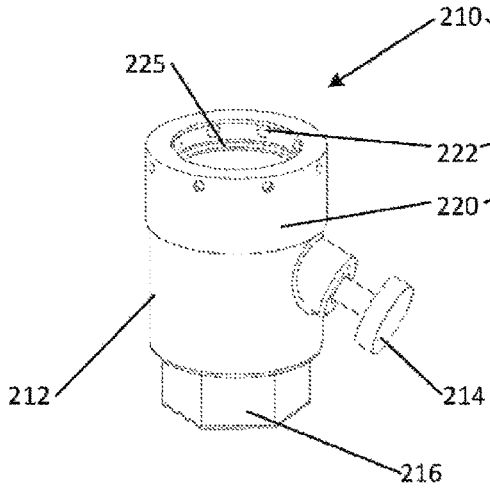
FIG. 15 is a perspective view of a drainage tool of another embodiment of the invention.
Figure 16:
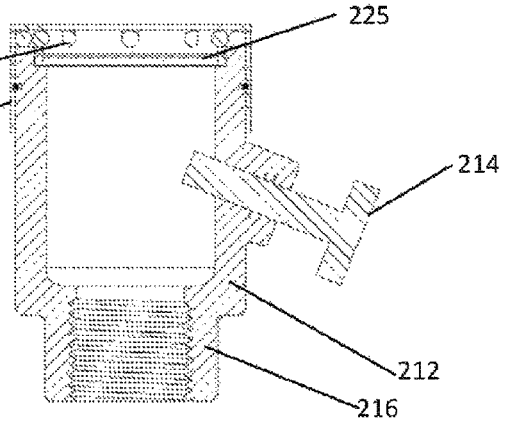
FIG. 16 is a sectional view of the tool of FIG. 15.

Tools 110 and 210, as illustrated in FIGS. 14 to 16, include a number of features in common with tool 10 and these features have been given like numbers incremented by 100 or 200 and the preceding description in relation to tool 10 is intended to apply to tools 110, 210 so that common features do not require further description.

Having regard to tool 110, housing 112 is formed of a plastic material and the lock includes a plurality of locking elements in the form of resilient arms 122 extending from the housing 112. Each arm 122 is configured to be resiliently flexible and move radially inwardly and outwardly to facilitate engagement between the tool 110 and the sprinkler 126 and removal of the tool 110 once desired. It will be appreciated that each arm 122 flexes about a base thereof and that the resilience or stiffness of each area is related to the type of material used and the cross sectional size of the arm.

An outer edge of each arm 122 is bevelled or angled on an inner side to urge the arm outwardly on contact with the sprinkler 126. Each arm 122 may be generally L shaped in longitudinal cross section with an inner bevelled or angled engagement surface to urge the arms 122 outwardly on retraction of the tool 110 to facilitate removal from the sprinkler 126.

In operation, as tool 110 is brought into engagement with the sprinkler 126 the arms 122 are urged outwardly to allow an outer edge of the sprinkler 126 to be received within the housing. Once arms 122 are located over correspondingly shaped recesses 130 formed in the sprinkler 126, the resilience of arms 122 allows the arms to move inwardly to fix the housing to the sprinkler 126. A sleeve 120, in the form of a collet nut is provided on the housing and as the collet nut 120 is advanced toward the sprinkler 126, the arms 122 are locked in position until removal of the tool 110 is desired. The collet nut 12 may also be formed of plastic material, or alternatively formed of a metallic material.

Although the locking elements are shown in the form of resilient arms 122 having a generally rectangular configuration, it will be appreciated that they make take other shapes and forms.

A tool 210 having a hybrid construction is illustrated in FIGS. 15 and 16. The tool 210 is constructed having a housing 210 formed of a plastic material and a sleeve 220 formed of a metallic material. The locking elements are preferably in the form of metallic balk 22.

In each of tools 110, 210, the housing 112, 212 is formed of a plastic material, which is preferably formed of a high strength plastic using an injection moulding process, though it will be appreciated that many different commercially available plastics and processes may be used.

Although useful for draining a fire sprinkler system, it will be appreciated that the described tools will have other applications. One such application is as a protective cover to prevent accidental damage to a fire sprinkler during building works. Another use of the described took is in connection with the installation or removal of a fire sprinkler. It will be appreciated that sprinklers, such as those illustrated in FIGS. 7 to 9, are configured so as to be tamper proof, thereby requiring use of the tool for installation or removal.

Although the invention has been described in relation to fire sprinklers, it will be appreciated that it may have application with sprinklers used for other purposes. Also, references to extinguishing fluids are intended to cover different fluids used in conventional fire sprinkler systems, such as water, chemicals, foaming agents or mixtures thereof, for example.

The embodiments have been described by way of example only and modifications are possible within the scope of the invention disclosed.

The invention claimed is:

1. A tool for draining a fire sprinkler system through a fire sprinkler, comprising:

a housing configured for cooperation with and to be sealingly secured to the sprinkler to collect fluid flowing from the sprinkler, wherein the housing is configured to sealingly surround the sprinkler and be advanced over an end of the sprinkler along a longitudinal axis at a center of an opening of the housing to sealingly surround the sprinkler;

a lock coupled to the housing, the lock being configured for releasable attachment to the sprinkler to secure the housing to the sprinkler by rotation of the lock relative to the sprinkler about the longitudinal axis at the center of the opening of the housing;

an actuator operable external of the housing to activate the sprinkler; and a conduit in fluid communication with the housing and through which the fluid can be drained.

2. The tool as claimed in claim 1, wherein the housing is configured for engagement with an adaptor fixed to the sprinkler.

3. The tool as claimed in claim 1, wherein said actuator has a pin extending internally of the housing and which is movable and wherein the pin is configured to be capable of displacing a temperature responsive element of the sprinkler to open a valve of the sprinkler and allow fluid to flow from the sprinkler.

4. The tool as claimed in claim 3, wherein the temperature responsive element is a bulb and the pin is configured to be capable of breaking the bulb.

5. The tool as claimed in claim 1, wherein the lock includes a sleeve which is movable relative to the housing to operate the lock.

6. The tool as claimed in claim 5, wherein the sleeve is coaxial with the longitudinal axis at the center of the opening of the housing and extends at least partially around the housing.

7. The tool as claimed in claim 1, wherein the lock includes at least one locking element which is configured for releasable engagement with the sprinkler or an adaptor fixed to the sprinkler.

8. The tool as claimed in claim 7, wherein the locking element(s) is radially movable.

9. The tool as claimed in claim 7, wherein the locking element has a spherical portion configured for receipt in a correspondingly shaped recess formed in the sprinkler or the adaptor.

10. The tool as claimed in claim 9, wherein the locking element is in the form of a ball disposed within a recess formed in the housing.

11. The tool as claimed in claim 1, further comprising a ball valve to control flow of water through the conduit.

12. The tool as claimed in claim 1, further comprising the housing having a seal extending between the sprinkler and the housing.

13. The tool as claimed in claim 1, further comprising a pressure transducer for determining the pressure of a chamber formed between the housing and the sprinkler.

14. The tool as claimed in claim 13, further comprising a pump to pressurize the chamber with air or water to determine whether the chamber is sealed.

15. The tool as claimed in claim 1, wherein the tool is configured for mounting to an end of a pole.

16. The tool as claimed in claim 1, wherein an opening of the lock is configured to receive the sprinkler along a longitudinal axis of the sprinkler.

17. A sprinkler configured for engagement with a tool, the tool comprising:

a housing configured for cooperation with the sprinkler to collect fluid flowing from the sprinkler, wherein the housing is configured to sealingly surround the sprinkler and be advanced over an end of the sprinkler along a longitudinal axis at a center of an opening of the housing to sealingly surround the sprinkler;

a lock coupled to the housing, the lock being configured for releasable attachment to the fire sprinkler to secure the housing to the sprinkler by rotation of the lock relative to the sprinkler about the longitudinal axis at the center of the opening of the housing;

an actuator operable external of the housing to activate the sprinkler; and a conduit in fluid communication with the housing and through which the fluid can be drained.

18. The sprinkler as claimed in claim 17, wherein the sprinkler comprises a base, the base being correspondingly shaped with the housing of the tool.

19. The sprinkler as claimed in claim 18, wherein the base is circular.

20. A method of draining a fire sprinkler system through a fire sprinkler, including the steps of:

fixing a drainage tool relative to and in sealing engagement with the sprinkler, the tool including a housing configured for cooperation with the sprinkler to collect fluid flowing from the sprinkler, wherein the housing is configured to sealingly surround the sprinkler and be advanced over an end of the sprinkler along a longitudinal axis at a center an opening of the housing to sealingly surround the sprinkler, a lock coupled to the housing, the lock being configured for releasable attachment to the fire sprinkler to secure the housing to the sprinkler by rotation of the lock relative to the sprinkler about the longitudinal axis at the center of the opening of the housing, an actuator operable external of the housing for activating the sprinkler, and a conduit in fluid communication with the housing and through which the fluid can be drained;

operating the actuator external of the housing to activate the sprinkler; and draining fluid from the system through the conduit.

21. The method as claimed in claim 20, wherein the tool is fixed to the sprinkler.

22. The method as claimed in claim 20, wherein the step of activating the sprinkler includes displacing a temperature responsive element of the sprinkler.

* * * * *